US005615964A

United States Patent [19]

Smith

[11] Patent Number: 5,615,964

[45] Date of Patent: Apr. 1, 1997

[54] ADAPTABLE LENGTH PEN REFILL SYSTEM INCLUDING A REFILL AND A METHOD FOR ADAPTING THE LENGTH OF THE REFILL

[75] Inventor: Paul Smith, Glenview, Ill.

[73] Assignee: Eversharp Pen Company, Franklin Park, Ill.

[21] Appl. No.: 434,027

[22] Filed: May 3, 1995

[51] Int. Cl.[6] ..... B43K 7/02

[52] U.S. Cl. ..... 401/210; 401/209; 401/195

[58] Field of Search ..... 401/210, 209, 401/195

[56] References Cited

U.S. PATENT DOCUMENTS 2,829,623 4/1958 Barnes ..... 401/210

3,346,100 10/1967 Carlson ..... 401/209 R 4,756,097 7/1988 Sanders ..... 36/72 B 5,207,524 5/1993 Arnold, III ..... 401/210

*Primary Examiner*—Steven A. Bratlie

*Attorney, Agent, or Firm*—Hill, Steadman & Simpson

[57] ABSTRACT

An adaptable length refill system and method are provided for replacing a refill in a pen housing. The refill is capable of adapting to any one of a number of available pen housings. To this end, a length of tubing is provided having a hollow core. At least one identifier is provided to identify a length of the tubing necessary to be removed to refill one of the available pens. A packaging card may be provided that is capable of holding the length of tubing and further having a scale thereon indicative of the length of tubing necessary to remove to refill one of the available pen housings. Alternatively, extension members may be added to increase the length of the tubing for insertions of an appropriate length refill into a specific pen housing.

11 Claims, 2 Drawing Sheets

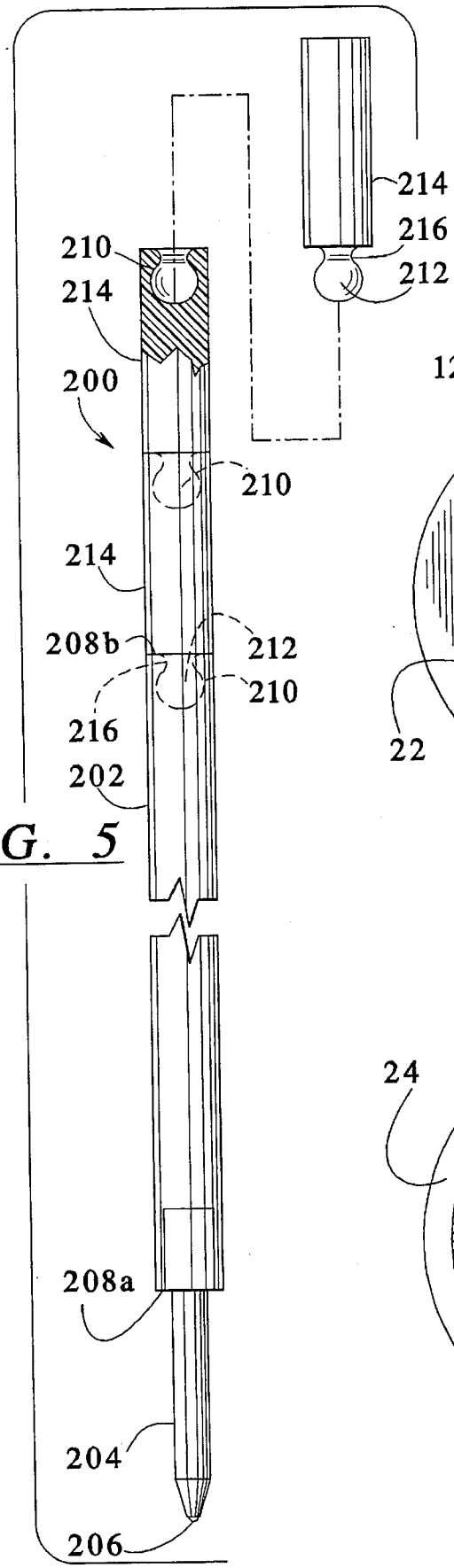
FIG. 5
FIG. 6
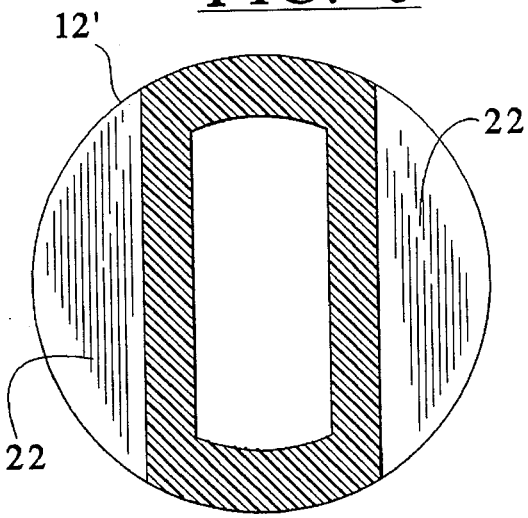
FIG. 7
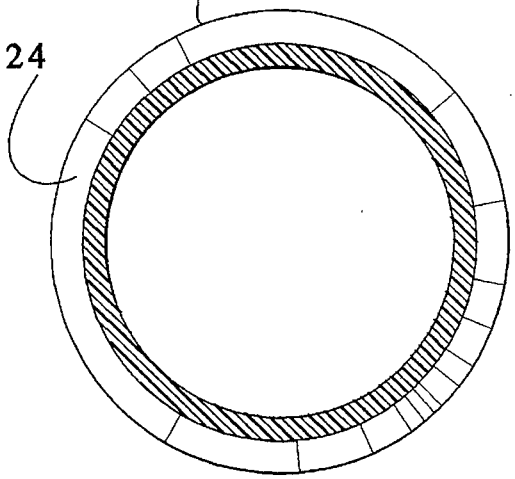

ADAPTABLE LENGTH PEN REFILL SYSTEM INCLUDING A REFILL AND A METHOD FOR ADAPTING THE LENGTH OF THE REFILL

BACKGROUND OF THE INVENTION

The present invention generally relates to an adaptable length pen refill. More specifically, the present invention relates to a system and a method for adapting the length of a pen refill for the refill to fit properly within any one of a variety of available pen housings.

On the market today, a number of ball point pens are generally available. Many such pens are manufactured with replaceable ink cartridges or refills. A standard pen is typically provided with an ink cartridge therein. When the supply of ink within the cartridge is exhausted, the ink cartridge can often be removed and replaced with a refill. As a result, the usefulness of the pen housing is restored.

Since a wide variety of pens is manufactured today to appeal to the marketplace, the size and shape of these pens, and hence the refills, vary considerably.

However, proper functioning of a pen depends on a refill properly fitting within a housing in which the refill is used. If the refill does not fit within the pen housing properly, the refill will not extend and retract properly within the housing. This may cause, for example, improperly flowing ink or insufficient contact of the ball point tip of the refill contacting the writing surface, and the like.

Available on the market today is a plurality of individually sold refills of various sizes, particularly varying in length, in order to fit properly within a pen housing. As a result, stores selling such refills must stock refills to fit every pen manufactured. Further, consumers are often confused when purchasing refills by the enormous variety of stock refills.

A number of attempts have been made to develop a refill with a length that may be altered to fit different size pen housings. Some of the known adaptable length refills require significant steps to manufacture the tubing of the refill such that the refill can be adapted to fit within any pen housing. Further, other lengths of tubing require aids in the manufacturing of the tubing to assist in breaking off segments of the tubing at specific locations.

A need, therefore, exists for a simplified refill and a method for providing an adaptable refill to fit within a variety of pen housings. A need further exists for an inexpensive and easy-to-use refill that can be used with a variety of pen housings.

SUMMARY OF THE INVENTION

The present invention provides an adaptable length refill system including a refill for one of a plurality of pens and a method for providing a single refill having an adaptable length for refill of one of a plurality of available pens.

To this end, in an embodiment, an adaptable length system including a refill for one of a plurality of available pens is provided. The system comprises a continuous length of tubing having a hollow core defined between a first end and a second end wherein the second end is sealed with a writing tip and the first end is open to receive ink within the hollow tube wherein the ink is selectively spent through the writing tip. At least one identifier means capable of identifying the length of the tubing between the first end and the second end is provided which identifies a point of the tubing that is necessary to remove to refill one of the plurality of available pens.

In an embodiment, the at least one identifier means is a demarcation line on the length of the tubing.

In an embodiment, the at least one identifier means is a notch along the length of tubing.

In an embodiment, the system has a packaging card capable of holding the length of tubing in a substantially sealed display wherein the packaging card further has a scale thereon indicative of the length of tubing necessary to remove to refill one of the plurality of available pens. The packaging card may include an outline of the length of tubing with the scale extending along the outline.

In an embodiment, the system has a means for cutting the length of tubing at a location of at least one of the identifier means.

In another embodiment of the present invention, a method provides a single refill having an adaptable length for refill of one of a plurality of available pens. The method comprises the steps of: providing a continuous length of hollow tubing having a substantially continuous diameter along the length of the tubing, the tubing holding ink therein; identifying at least one specified portion of the length of the tubing required to be removed from the length of tubing in order for the refill to adapt to a specific one of the plurality of available pens; and cutting the length of tubing along the length of the at least one specified portion.

In an embodiment, the method further comprises the step of providing a template having a scale capable of identifying the at least one specified portion.

In an embodiment, the method further comprises the step of providing packaging capable of sealing the refill wherein the packaging includes a scale identifying the at least one specified portion.

In an embodiment, the method further comprises the step of providing at least one demarcation line along the length of tubing to identify the at least one specified portion.

In an embodiment, the method further comprises the step of providing at least one notch along a length of the tubing to identify the at least one specified portion. The at least one notch is angularly graded with respect to the length of tubing.

In an embodiment, providing a cutting means for cutting the length of tubing.

In another embodiment of the present invention, an adaptable length refill system includes a refill for one of a plurality of available pens. The system has a continuous length having a hollow core defined between an open first end and a second end enclosed by a writing tip wherein the hollow core includes ink therein that is selectively spent through the writing tip. At least one plug is insertable into the open end of the length of tubing having a diameter equivalent to the length of tubing along its length and a means for attaching at a first end of the plug for attaching the plug to the open first end of the length of tubing and a means for receiving at a second end of the plug capable of receiving a means for attaching an additional plug.

In an embodiment, the means for attaching is a reduced diameter section having a diameter less than the diameter of the plug.

In an embodiment, a neck portion is integrally connected to the means for attaching to the plug wherein the means for attaching has a substantially spherical shape.

In another embodiment of the present invention, a method provides a single refill having an adaptable length for refill of one of a plurality of available pens. The method comprises the steps of: providing a continuous length of hollow tubing having a substantially continuous diameter along the length of the tubing wherein the tubing holds ink therein; and providing at least one extender capable of inserting in an end of the hollow tubing to extend its length, the extender having an outside diameter equal to the continuous diameter of a length of the tubing and a plug integrally formed with the extender and capable of providing a friction fit in the end of the hollow tubing wherein insertion of the extender in the hollow tubing extends the length of the hollow tubing.

It is, therefore, an advantage of the present invention to provide a system and a method for refilling a pen housing with an adaptable length refill.

Yet another advantage of the present invention is to provide a system and a method that simply adapts the length of a refill for a pen housing.

Further, an advantage of the present invention is to provide a system and a method for adjusting the length of tubing that may be inexpensively manufactured.

A still further advantage of the present invention is to provide a system and a method for providing an adaptable length refill that simply identifies the necessary length given the pen housing.

Moreover, an advantage of the present invention is to provide a system and a method for adapting the length of a refill without varying the diameter of the refill itself.

Additional features and advantages of the present invention are described in, and will be apparent from, the detailed description of the presently preferred embodiments and from the drawings.

BRIEF DESCRIPTION OF THE DRAWINGS

FIG. 5 illustrates a side elevational view of another embodiment of an adaptable pen refill system of the present invention.

FIG. 6 illustrates a cross-sectional view of an embodiment of a refill system of the present invention taken generally along the line VI—VI of FIG. 2.

FIG. 7 illustrates a cross-sectional view of an embodiment of a refill of the present invention taken generally along the line VII—VII of FIG. 3.

DETAILED DESCRIPTION OF THE PRESENTLY PREFERRED EMBODIMENTS

A system and a method are provided for adapting the length of a refill for insertion into a pen housing. In a preferred embodiment, the system includes a refill and a cutting means to adapt the length of the refill.

Figure 1:
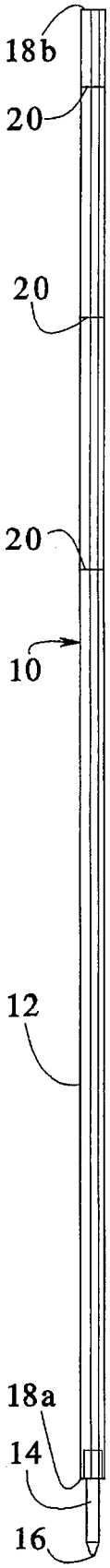
FIG. 1 illustrates a side elevational view of an embodiment of a pen refill of the present invention.

Referring now to the drawings, FIG. 1 illustrates a refill 10. The refill 10 includes a body 12 preferably formed from a continuous length of plastic. The body 12 is tubular with a hollow interior for receiving ink therein. At one end of the body 12 is attached a writing head 14 having a ball point 16. The writing head 14 is attached at an open end 18*a* of the body 12. The opposite end 18*b* of the body 12 remains open for filling of the refill 10 with a level of ink as is commonly known. Along the length of the body 12 are transverse lines 20 that are drawn or otherwise demarcated on the exterior of the body 12 or inside the body 12, particularly for transparent or translucent tubing wherein the transverse line 20 may be easily distinguished.

Figure 2:
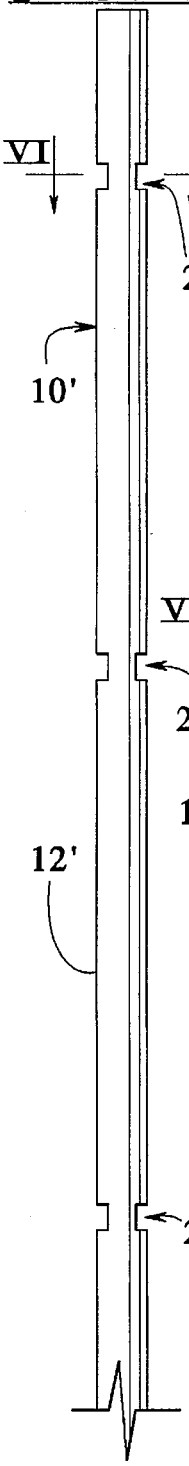
FIG. 2 illustrates a side elevational view of a portion of an embodiment of a pen refill of the present invention.
Figure 3:
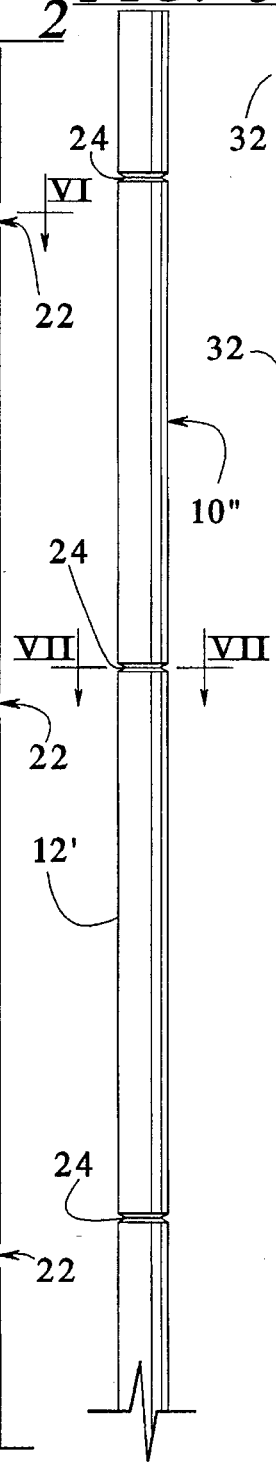
FIG. 3 illustrates a side elevational view of an embodiment of a portion of a pen refill of the present invention.

Referring to FIGS. 2 and 3, alternate embodiments of the refill 10 shown in FIG. 1 are illustrated. One such refill 10' is illustrated in FIG. 2 having one or more notched or cut-out sections 22 along its length. FIG. 3 illustrates another embodiment of a refill 10" with graded notches 24 along its length. The notched sections 22 and graded notches 24 provide positive identification marks along the length of bodies 12' and 12", respectively, of the refills 10' and 10". Such identification marks assist a user in replacing a refill by providing immediate identification points to remove or otherwise separate a portion of the length of the tubular body.

Figure 4:
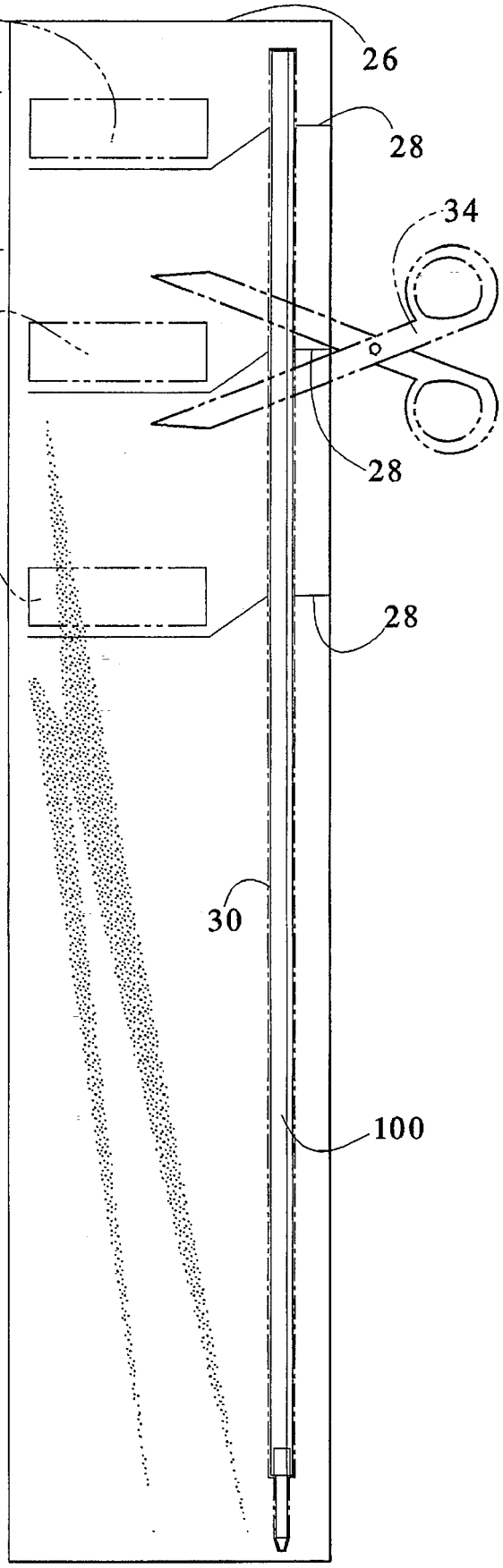
FIG. 4 illustrates a side elevational view of an embodiment of packaging including a scale for cutting a refill in an embodiment of the present invention.

Referring to FIG. 4, packaging 26 having scale lines 28 thereon is illustrated. An outline 30 of a refill included in the package is sketched on the package. A refill 100 can be placed within the outline 30 as illustrated in FIG. 4 and the scale lines 28 can then be used as marks indicative of portions of the refill 100 that should be removed depending on the type of pen housing in which the refill 100 is to be used.

To this end, descriptions of pen types may be provided within the descriptive sections 32. Each of the descriptive sections 32 recites, for example, the types of pens in which a particular length of refill is required. In the embodiment illustrated in FIG. 4, a plurality of types of pens may be described in each of the descriptive sections 32. Therefore, one or more pen types may require refills having different lengths as shown by the scale line 28. A pair of scissors 34 or other cutting mechanism may be provided with the packaging 36 including the refill 100 to assist in cutting the refill 100. Likewise, any one of the embodiments of the refills illustrated in FIGS. 1, 2 and 3 may be cut with the scissors 34 or other cutting means at their designated locations as shown by the transverse lines 20, the notched sections 22 and the graded notches 24.

In a preferred embodiment of the present invention, the scissors 34 are miniaturized and suitable for a single or only a few uses. The scissors 34 may be constructed such that, following use, they may be discarded. Alternatively, the scissors 34 may be saved for ordinary use.

FIG. 5 illustrates another embodiment of a refill 200 of the present invention. In this instance, however, the standard tubing 202 requires "add-ons" to its length to increase the overall length of the refill 200 depending on the pen housing in which the refill 200 is to be used.

As illustrated in FIG. 5, the refill 200 includes a writing head 204 having a ball point 206. The writing head 204 encloses one end 208*a* of the body 202. The other end 208*b* of the body 202 of the refill 200 includes a receiving portion 210 that receives a connecting member 212 integrally formed to an extension member 214. The connecting member 212 includes a neck portion 216 having a lesser diameter than the diameter of the connecting member 212. As a result, the connecting member 212 may be snap fit into the receiving portion 210 at the end 208*b* of the body 202. The connecting member 212 further includes a breathing hole or vent generally designated at 215. The breathing hole 215 allows air to enter or exit the body 200 of the refill 200.

Each extension member 214 includes an identical receiving portion 210 as the end 208*b* of the body 202 for receipt of subsequent extension members 214 added to the length of the refill 200. As a result, depending on the pen housing in which the refill 200 is used, the length of the body 202 of the refill 200 can be lengthened to a necessary length for the pen housing in which the refill is to be used.

Referring to FIGS. 6 and 7, cross-sectional views taken generally along the line VI—VI of FIG. 2 and VII—VII of FIG. 3, respectively, are shown. The notched section 22 as illustrated in FIG. 2 is formed by compressing a portion of the walls of the body 12'. Likewise, in FIG. 7, the graded notch 24 around a periphery of the tubular body 12" is formed so as to reduce the cross-sectional area in a portion along the length of the tubular body 12" at specified points. The notched sections 22 and graded notches 24, as discussed with reference to FIGS. 2 and 3, assist a user in readily identifying locations at which the length of the refill can be reduced to satisfy necessary uses of the refill within specific pen housings.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. An adaptable length refill system including a refill system for one of a plurality of available pens, the system comprising:

a continuous length of tubing having a hollow core defined between a first end and a second end wherein the second end is sealed with a writing tip and the first end is open to receive ink within the hollow tube wherein the ink is selectively spent through the writing tip;

at least one identifier means capable of identifying the length of the tubing between the first end and the second end necessary to remove to refill one of the plurality of available pens; and a packaging card capable of holding the length of tubing in a substantially sealed display, the packaging card further having a scale printed thereon indicative of the length of tubing necessary to remove to refill one of the plurality of available pens.

2. The adaptable length refill system of claim 1 wherein the at least one identifier means is a demarcation line on the length of the tubing.

3. The adaptable length refill system of claim 1 wherein the at least one identifier means is a notch along the length of tubing.

4. The adaptable length refill system of claim 1 wherein the packaging card includes an outline of the length of tubing with the scale extending along the outline.

5. The adaptable length refill system of claim 1 further comprising:

means for cutting the length of tubing at a location of at least one of the identifier means.

6. A method for providing a single refill having an adjustable length for refill of one of a plurality of available pens, the method comprising the steps of:

providing a continuous length of hollow tubing having a substantially continuous diameter along the length of the tubing, the tubing holding ink therein;

identifying at least one specified portion of the length of the tubing required to be removed from the length of tubing in order for the refill to adapt to a specific one of the plurality of available pens;

cutting the length of tubing along the length of the at least one specified portion; and providing packaging capable of sealing the refill wherein the packaging includes a scale printed thereon identifying the at least one specified portion.

7. The method of claim 6 further comprising the step of:

providing a template having a scale capable of identifying the at least one specified portion.

8. The method of claim 6 further comprising the step of:

providing at least one demarcation line along the length of tubing to identify the at least one specified portion.

9. The method of claim 6 further comprising the step of:

providing at least one notch along a length of the tubing to identify the at least one specified portion.

10. The method of claim 9 wherein the at least one notch is angularly graded with respect to the length of tubing.

11. The method of claim 6 further comprising the step of:

providing a cutting means for cutting the length of tubing.

* * * * *